US007434722B2

(12) United States Patent
Martin

(10) Patent No.: US 7,434,722 B2
(45) Date of Patent: Oct. 14, 2008

(54) PACKAGING FOR EQUIPMENT, IN PARTICULAR ELECTRICAL INSTALLATION EQUIPMENT

(75) Inventor: Werner Martin, Leimen (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 11/639,261

(22) Filed: Dec. 15, 2006

(65) Prior Publication Data

US 2007/0138246 A1 Jun. 21, 2007

(30) Foreign Application Priority Data

Dec. 17, 2005 (DE) ..... 20 2005 019 776 U

(51) Int. Cl.
*B65D 17/28* (2006.01)
*B65D 17/34* (2006.01)

(52) U.S. Cl. ..... 229/228; 229/154; 229/193; 229/224

(58) Field of Classification Search ..... 229/122.24, 229/144, 145, 151, 152, 153, 154, 193, 224, 229/225, 226, 227, 228
See application file for complete search history.

(56) References Cited

U.S. PATENT DOCUMENTS 1,555,045 A * 9/1925 Walter ..... 229/122.26
2,114,134 A * 4/1938 Weiss ..... 229/212
2,114,422 A 4/1938 Guyer
2,429,540 A * 10/1947 Woodruff ..... 229/132
2,572,159 A * 10/1951 Kells et al. ..... 229/149
2,828,060 A 3/1958 Brown
2,925,841 A * 2/1960 Brunner ..... 190/115

(Continued)

FOREIGN PATENT DOCUMENTS

DE 16 90 651 U 1/1955

(Continued)

OTHER PUBLICATIONS

German Search Report.

*Primary Examiner*—Gary E Elkins
(74) *Attorney, Agent, or Firm*—Buchanan Ingersoll & Rooney PC

(57) ABSTRACT

Packaging is disclosed for electrical installation equipment, in particular, made from a folded cardboard box, with two parallel first cardboard portions which form a front and a rear wall of the packaging and with two second cardboard faces extending perpendicular thereto, of which the cardboard face forms the bottom wall and the cardboard face forms the upper wall, with first flaps formed on the longitudinal edges of the front and rear wall and the bottom wall, which are attached to the longitudinal edges and able to be bent towards one another, so that they are in a single plane, with cover flaps attached to the edges of the upper wall extending in line with the longitudinal edges and which cover the first flaps and are bonded thereto, and with a third flap arranged on the upper wall which terminates on the edge of the upper wall opposing the front wall and is bonded from inside against the inner face of the front wall. First perforations are provided between the upper wall and the cover flaps, and second perforations are provided between the third flap and the upper wall on at least one partial portion, so that the upper wall may be torn open and the equipment located therein may be removed.

5 Claims, 2 Drawing Sheets

U.S. PATENT DOCUMENTS

| | | | | |
|---|---|---|---|---|
| 3,318,508 | A * | 5/1967 | Buttery | 229/227 |
| 4,046,313 | A * | 9/1977 | Perry | 229/227 |
| 4,643,315 | A * | 2/1987 | Hopwood et al. | 229/236 |
| 5,975,413 | A * | 11/1999 | Moen | 229/122.24 |
| 6,168,074 | B1 * | 1/2001 | Petriekis et al. | 229/122.24 |

FOREIGN PATENT DOCUMENTS

| | | | |
|---|---|---|---|
| DE | 69 29 371 | U | 10/1968 |
| DE | 93 18 993 | U1 | 3/1994 |
| DE | 10 2004 020 526 | A1 | 11/2005 |
| EP | 0 282 344 | A2 | 9/1988 |
| GB | 473018 | | 9/1937 |
| GB | 876063 | | 8/1961 |

* cited by examiner

PACKAGING FOR EQUIPMENT, IN PARTICULAR ELECTRICAL INSTALLATION EQUIPMENT

CROSS REFERENCE TO RELATED APPLICATIONS

This application claims priority under 35 U.S.C. §119 to German Application 20 2005 019 776.9 filed in Germany on 17 Dec. 2005, the entire contents of which are hereby incorporated by reference in their entirety.

FIELD

Packaging is disclosed for equipment.

BACKGROUND

Such packaging substantially serves for packaging single-pole or double-pole circuit breakers. With the known packaging, for opening, the upper wall is torn open at the edges, at which the upper wall is connected to the front and rear walls. A so-called roller shutter effect is produced when tearing open, however, as the width of the upper wall is too narrow.

SUMMARY

Packaging of the aforementioned type is disclosed in which the opening is simplified for removing the equipment used.

BRIEF DESCRIPTION OF THE DRAWINGS

Further advantageous embodiments and improvements and further advantages are to be described and disclosed in more detail with reference to the drawings, in which an embodiment of the invention is shown and in which.

DETAILED DESCRIPTION

Figure 1:
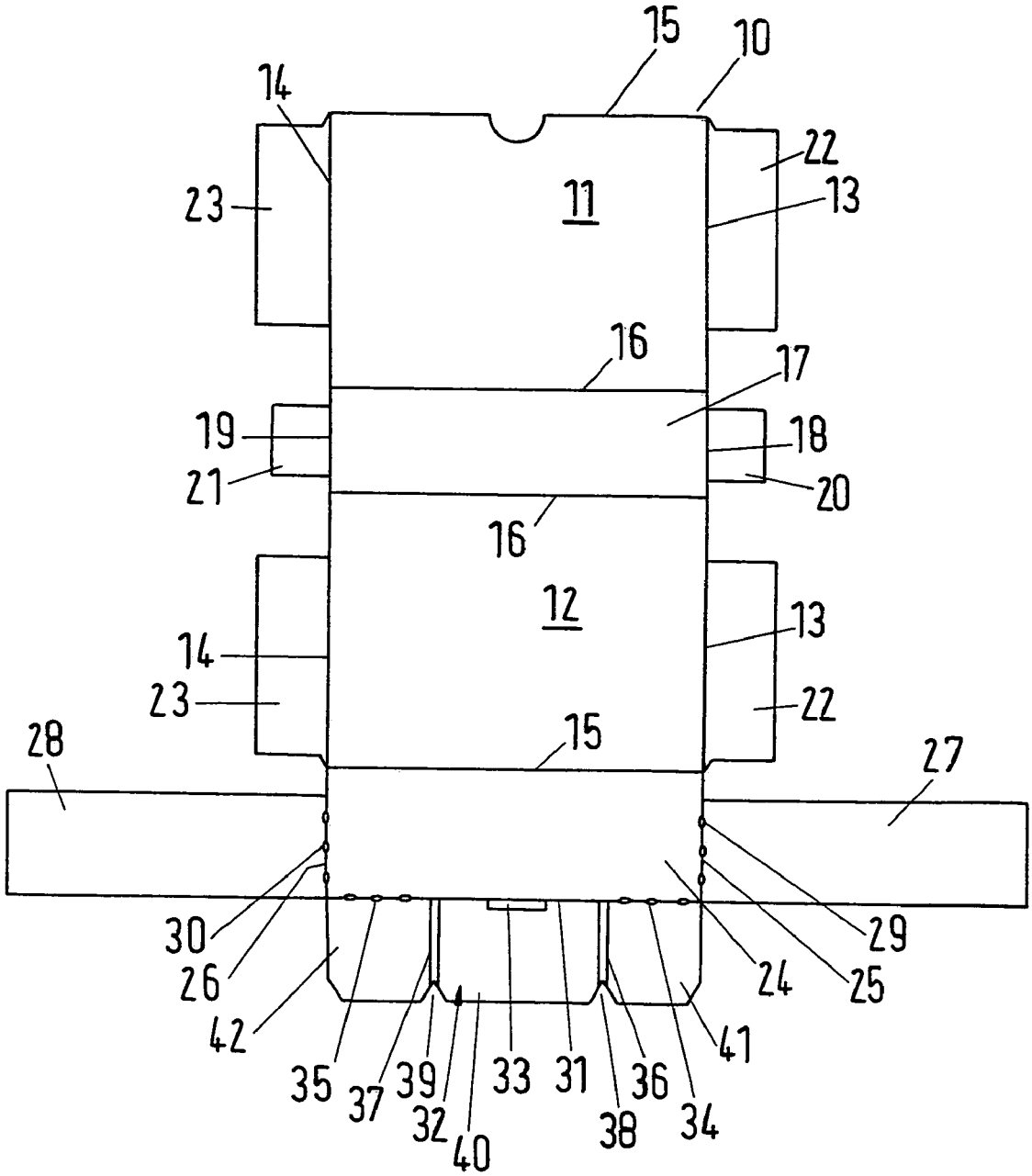
FIG. 1 is a developed view of an exemplary packaging.

FIG. 1 shows an exemplary packaging in the developed state, the packaging consisting of cardboard which is stamped out in the manner shown in FIG. 1.

The stamped-out cardboard which has the reference numeral 10, has two rectangular portions 11, 12 of which the side edges 13, 14 and the transverse edges 15, 16 are approximately the same, so that a square or a rectangle is formed.

The same applies to the side edges and transverse edges of the portion 12.

The transverse edges 16 of the two portions 11 and 12 are connected to one another by means of a further portion 17, weakened portions being provided on the transverse edges 16 between the portions 11, 17 and/or 12, 17, so that at these edges 16 the two portions 11, 12 may be bent upwards perpendicularly towards the portion 17.

Flaps 20, 21 are formed on the edges 18 and 19 of the portion 17 and which are located in line with the edges 13 and 14, the width of said flaps being smaller in the direction of the edges 13/18 and/or 14/19 than the width of the portion 17, measured in the same direction. Two flaps 22, 23 are formed on the edges 13, 14 of the portions 11, 12, the dimensions of said flaps being shorter in the longitudinal direction by the length of the flaps 20, 21, measured in the direction of the transverse edges 16. The flaps 22, 23 are practically attached to the transverse edges 15, so that they are arranged eccentrically on the longitudinal edges 14. The distance of the edges of the flaps 22, 23, extending perpendicularly to the longitudinal edges 14, 13, from the edges 16, corresponds to the length of the flaps 20, 21.

A third portion 24 is attached to the transverse edge 15 of the portion 12, to the edges 25, 26 of which, located in line with the longitudinal edges 13, 14, are attached cover flaps 27 and 28, which with the portions 11, 17 and 12 form a T shape. Perforations 29, 30 are provided on these edges 25, 26.

A further flap 32 is attached to the edge 31 of the portion 24 extending parallel to the edge 15, a through-slit 33 being formed in the centre in the region of the edge 31 and perforations 34 and 35 being formed on both sides thereof in the region of the edge 31. The flap 32 has two weakened portions 36, 37 which project perpendicularly thereto from the edge 31 towards the end, and open into V-shaped portions 38, 39 there. The perforations are located outside the weakened portions 36, 37.

If the cardboard 10 is now intended to be made up into and/or formed into packaging, the portions 11, 12 are bent upwards perpendicularly to the portion 17, so that the portion 11 forms the front wall and the portion 12 forms the rear wall of the packaging, and the portion 17 the bottom wall. Then the portion 24 together with the flap 32 are bent about the edge 15, so that the portion 24 extends parallel to the portion 17 and forms the upper wall of the packaging. The flap 32 is bent around the edge 31 and, more specifically, perpendicularly thereto, so that it extends parallel to the front wall 11; the flap is therefore located inside the packaging and may be bonded, with the outside of the weakened portions 36, 37, against the inner wall of the wall in front or front wall. Then the flaps 22, 23 and the flaps 20, 21 are bent towards one another, so that they are in a single plane; then the cover flaps 27 and 28 are bent perpendicularly to the edges 25 and 26, so that the cover flaps 27 and 28 cover the inwardly bent flaps 22 and 23 and 20, 21. The cover flaps 27, 28 are then bonded to the flaps 20, 21, 22, 23.

Figure 2:
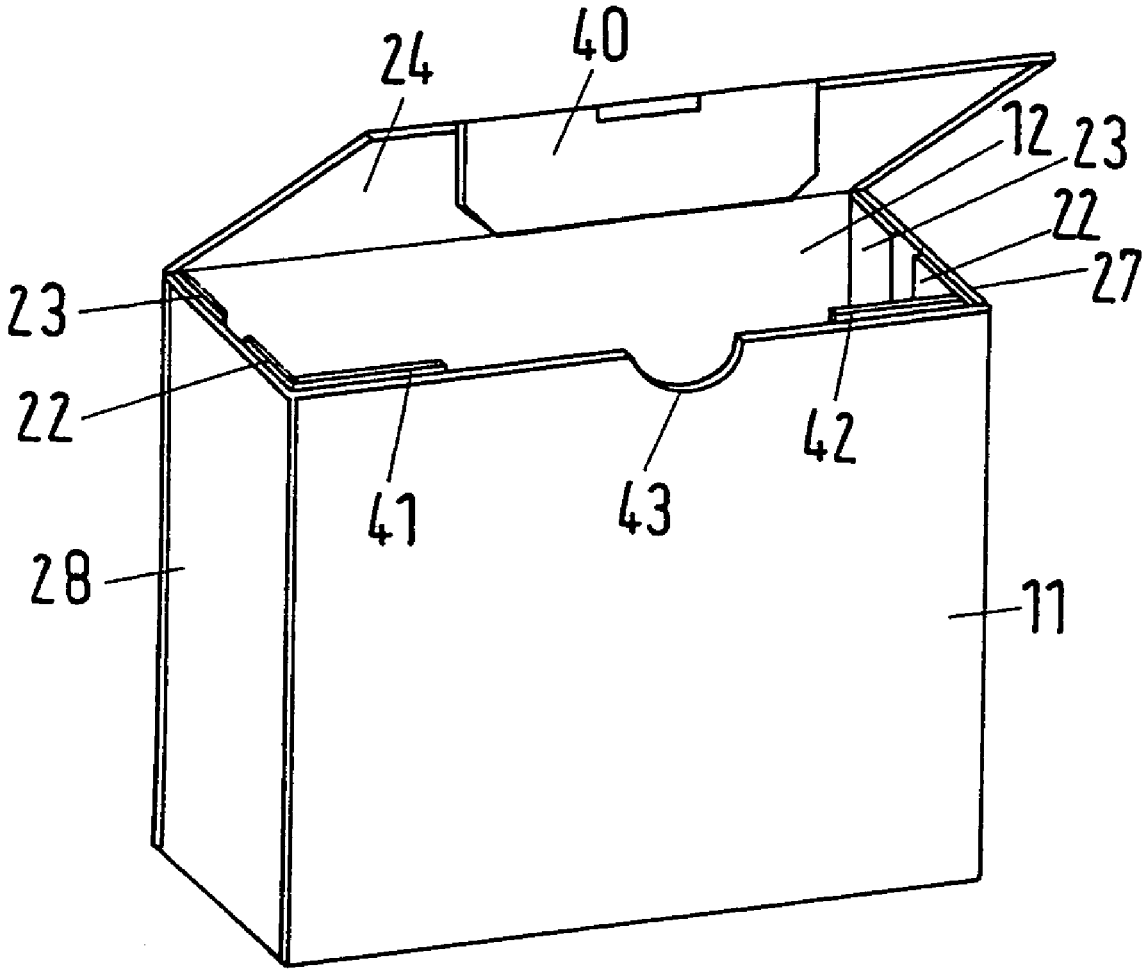
FIG. 2 is the exemplary packaging in the opened state, in a perspective view.

FIG. 2 shows an exemplary cardboard box in the finished, torn-open form. The portion 11 serving as a front wall and the portion 12 serving as a rear wall and the cover flaps 28 and 27 which cover the flaps 22 and 23 being visible. The portion 24 forming the upper wall is torn open at the perforations 29, 30 and 34, 35 and the portion 40 of the flap 32 located between the weakened portions 36 and 37 is formed on the portion 24.

In a corresponding manner, the front wall has the reference numeral 11, the rear wall the reference numeral 12 and the upper wall the reference numeral 24; optimal guiding of the flap portion 40 is obtained by the portions 41, 42 of the flap 32 located outside the weakened portions and which are also still visible in FIG. 2.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. Packaging for equipment, comprising:

a box, including parallel first and second portions which respectively form a front and a rear wall of the packaging;

first and second faces that in a folded state extend perpendicular to the first and second portions, wherein the first face forms a bottom wall and the second face forms an upper wall;

first flaps formed on longitudinal edges of the front and rear wall and the bottom wall, and attached to the longitudinal edges and configured to be bent towards one another, so that in a folded state they are in a single plane;

cover flaps attached to longitudinal edges of the upper wall and extending in line with the longitudinal edges of the upper wall and which cover the first flaps in a folded state and are bonded thereto; and a third flap including a central region and two partial portions and arranged on the upper wall and which terminates on an edge of the upper wall opposing the front wall and which in a folded state is bonded from inside against an inner face of the front wall, wherein first perforations are provided between the upper wall and the cover flaps and second perforations are provided between the third flap and the upper wall on the two partial portions the central region being free of perforations so that the upper wall may be torn open and the equipment located therein may be removed.

2. Packaging according to claim 1, wherein a notch is provided on the front wall in the region of the upper wall of which the dimension is selected so that opening is possible with a user's thumbs and wherein weakened portions are provided on the third flap extending perpendicularly to an end edge of the third flap and which extend on both sides of the central region towards the notch, so that when tearing open, firstly by pressing in the third flap, the central region of the third flap tears therewith.

3. Packaging according to claim 2, wherein in a folded state the third flap is bonded outside the weakened portions to the inner face of the front wall.

4. Packaging according to claim 1, wherein the equipment for packaging is an electrical installation equipment.

5. Packaging according to claim 1, wherein the box is formed from cardboard.

* * * * *